United States Patent [19]

Fujita

[11] Patent Number: 4,621,494

[45] Date of Patent: Nov. 11, 1986

[54] AUTOMOTIVE ENGINE EXHAUST SYSTEM

[75] Inventor: Kazunori Fujita, Tokyo, Japan

[73] Assignee: Nissan Motor Co., Ltd., Japan

[21] Appl. No.: 639,426

[22] Filed: Aug. 10, 1984

[30] Foreign Application Priority Data

Aug. 31, 1983 [JP] Japan ..... 58-161116

[51] Int. Cl.[4] ..... F02B 27/02; F01N 7/10

[52] U.S. Cl. ..... 60/313; 60/323; 181/240

[58] Field of Search ..... 60/313, 323, 282; 181/240

[56] References Cited

U.S. PATENT DOCUMENTS

| | | | |
|---|---|---|---|
| 4,110,976 | 9/1978 | Oya et al. . | |
| 4,197,704 | 4/1980 | Date | 60/313 |
| 4,206,600 | 6/1980 | Feuling | 60/312 |

FOREIGN PATENT DOCUMENTS

| | | | |
|---|---|---|---|
| 18521 | 2/1977 | Japan | 60/313 |
| 790330 | 2/1958 | United Kingdom . | |
| 971405 | 9/1964 | United Kingdom | 181/240 |
| 997586 | 7/1965 | United Kingdom . | |
| 2021688 | 12/1979 | United Kingdom . | |
| 2101205 | 1/1983 | United Kingdom | 60/312 |

*Primary Examiner*—Douglas Hart

*Attorney, Agent, or Firm*—Leydig, Voit & Mayer

[57] ABSTRACT

A pair of front exhaust pipes are joined to a rear exhaust pipe by an exhaust pipe joint. The front exhaust pipes have downstream end portions projecting into the exhaust pipe joint so that between the outer walls of the downstream end portions and the inner walls of the exhaust pipe joint there are formed annular spaces for receiving reflected waves travelling in the upstream direction and limiting the propagation of the reflected waves into the downstream ends of the front exhaust pipes.

7 Claims, 10 Drawing Figures

AUTOMOTIVE ENGINE EXHAUST SYSTEM

BACKGROUND OF THE INVENTION

1. Field of the Invention

The present invention relates in general to automotive internal combustion engines and more particularly to exhaust systems thereof.

2. Description of the Prior Art

Such an exhaust system of an automotive engine is known in the art that includes two front exhaust pipes, one rear exhaust pipe located downstream of the front exhaust pipes and a Y-shaped exhaust pipe joint joining the front and rear exhaust pipes.

In this kind of exhaust system, such exhaust pressure waves (reflected waves) are liable to arise that propagate from the exhaust pipe joint back to the front exhaust pipes to interfere with other exhaust pressure waves. Due to this, shock waves are liable to be caused at the front exhaust pipes, resulting in an increased exhaust noise and a decreased exhaust efficiency and therefore a decreased engine output.

SUMMARY OF THE INVENTION

In accordance with the present invention, there is provided an exhaust system for an automotive engine which comprises a pair of front exhaust pipes, a rear exhaust pipe located downstream of the front exhaust pipes, an exhaust pipe joint joining the front exhaust pipes to the rear exhaust pipe, the front exhaust pipes having downstream end portions projecting into the exhaust pipe joint, and means for forming annular spaces around the downstream end portions.

In one embodiment, the exhaust pipe joint is trifurcated to have two upstream branches in which the front exhaust pipes are fitted and one downstream branch in which the rear exhaust pipe is fitted. The downstream end portions of the front exhaust pipes are tapered toward the distal ends to have conical outer walls. The upstream branches have inner walls surrounding the conical outer walls and cooperating with same to form therebetween the annular spaces. The conical outer walls of the tapered downstream ends of the front exhaust pipes and the inner walls of the upstream branches of the exhaust pipe joint constitute the annular space forming means.

The above structure is quite effective for overcoming the disadvantages noted above.

It is accordingly an object of the present invention to provide an improved exhaust system for an automotive engine which is free from the disadvantages of the prior art exhaust system.

It is a further object of the present invention to provide an improved exhaust system of the aforementioned character which, with a simple improvement and therefore with a minimum cost, can considerably reduce an exhaust noise and effectively increase an exhaust efficiency and therefore an engine output.

BRIEF DESCRIPTION OF THE DRAWINGS

The features and advantages of the exhaust system according to the present invention will become more clearly appreciated from the following description taken in conjunction with the accompanying drawings, in which.

DESCRIPTION OF THE PREFERRED EMBODIMENTS

Figure 1:
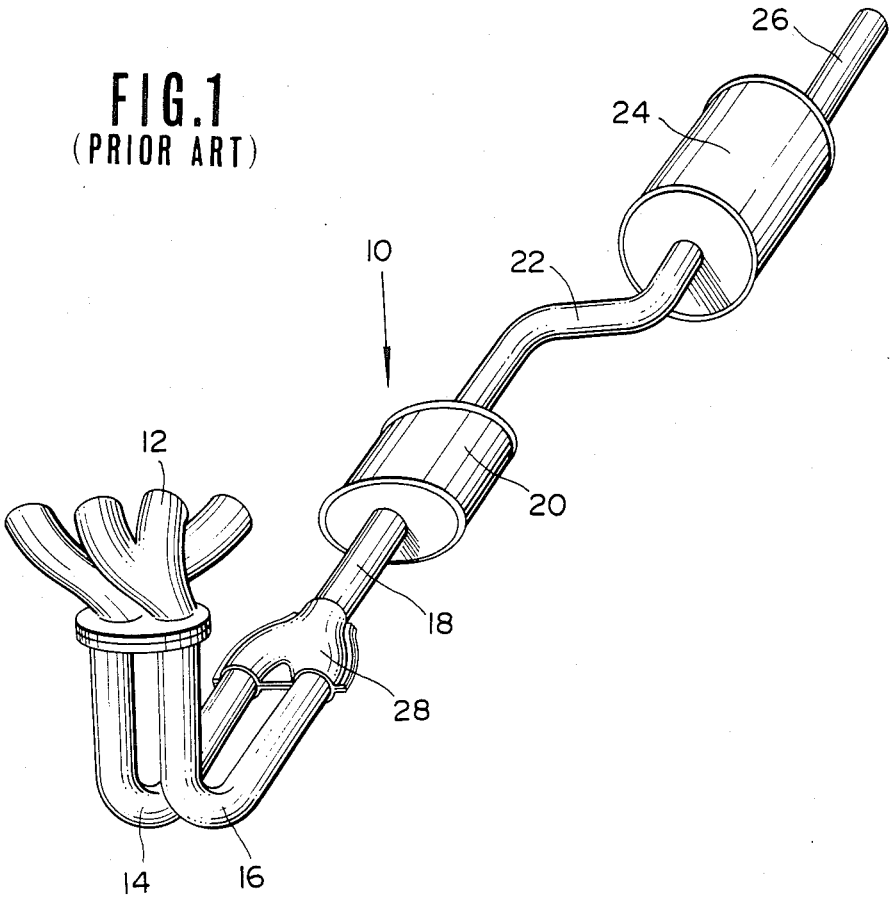
FIG.1 (PRIOR ART)
FIG. 1 is a perspective view of a prior art exhaust system of an automotive engine.
Figure 2:
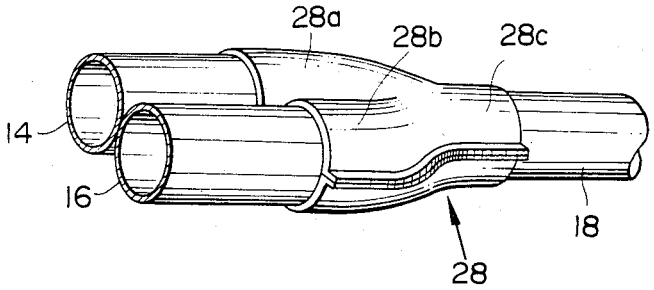
FIG.2 (PRIOR ART)
FIG. 2 is an enlarged perspective view of an exhaust pipe joint and its associated exhaust pipes employed in the the exhaust system of FIG. 1.
Figure 3:
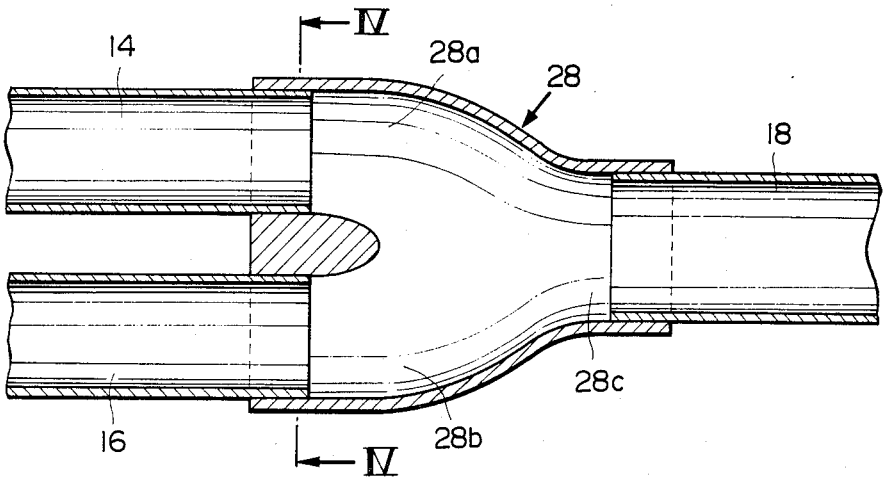
FIG. 3 (PRIOR ART)
FIG. 3 is a longitudinal sectional view of the exhaust pipe joint and its associated exhaust pipes of FIG. 2.
Figure 4:
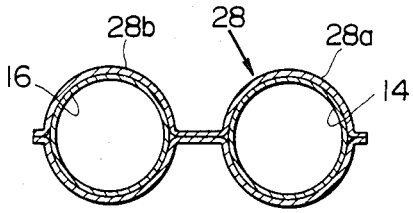
FIG. 4 (PRIOR ART)
FIG. 4 is a cross sectional view taken along the line IV—IV of FIG. 3.

Referring to FIGS. 1 to 4, description is first made to a prior art exhaust system of an automotive internal combustion engine for a better understanding of the inventive step of the present invention.

The prior art exhaust system is generally designated by 10 and consists of an exhaust manifold 12, a pair of front exhaust pipes 14 and 16, a rear exhaust pipe 18, a front muffler 20, an intermediate exhaust pipe 22, a rear muffler 24 and a tailpipe 26, which are arranged one after another.

The pair of front exhaust pipes 14 and 16 are arranged in parallel and joined to the single rear exhaust pipe 18 by means of an exhaust pipe joint 28. The joint 28 is Y-shaped or trifurcated to have two upstream branches **28*a* and 28*b* and one downstream branch 28*c*. The downstream ends of the front exhaust pipes 14 and 16 are inserted into the upstream branches 28*a* and 28*b* and adapted to fit closely or snugly in same, that is, the matching outer and inner surfaces of the front exhaust pipes 14 and 16 and the exhaust pipe joint 28 are adapted to contact fittingly each other without substantially any space therebetween as will be seen from FIGS. 3 and 4. The upstream end of the rear exhaust pipe 18 is inserted into the downstream branch 28*c*** and adapted to fit closely or snugly in same.

In this kind of prior art exhaust system, as the burned gases (exhaust) are discharged from associated engine cylinders (not shown) into the exhaust system, exhaust pressure waves arising in the exhaust manifold 12 propagate through the exhaust line in the direction of the flow of the exhaust gases and may change at the downstream end of the tailpipe 26 into reflected waves that propagate back through the exhaust line to the joint 28. The exhaust pressure waves (reflected waves) having propagated back to the joint 28 tend to further propagate therefrom to the front exhaust pipes 14 and 16 to interfere with other exhaust pressure waves. Due to this, shock waves are liable to be caused at te front exhaust pipes 14 and 16, resulting in an increased exhaust noise and a decreased exhaust efficiency and therefore a decreased engine output.

Such disadvantages and shortcomings of the prior art exhaust system can be overcome by the present invention which will be described hereinafter with reference to FIGS. 5 to 10, in particular. In FIGS. 5, 6 and 8 to 10 illustrating preferred embodiments of this invention, some constituent parts are omitted wholly and partly since the omitted parts and portions are substantially the same as those of the prior art exhaust system of FIG. 1, and constituent parts like or corresponding to those of the prior art exhaust system of FIG. 1 are designated by the same reference numerals as their corresponding parts and will not be described again.

Figure 5:
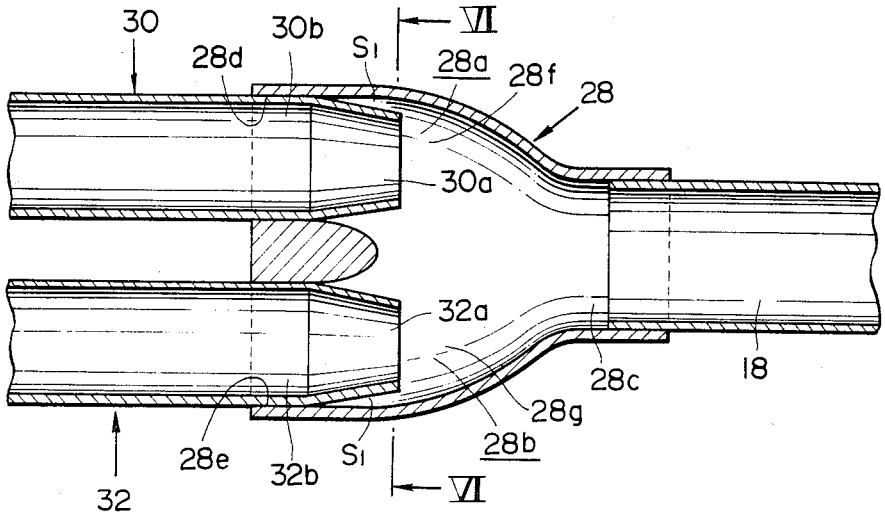
FIG. 5 is a view similar to FIG. 3 but showing an embodiment according to the present invention.
Figure 6:
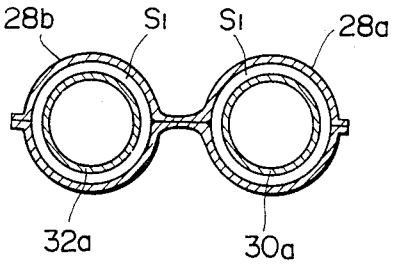
FIG. 6 is a cross sectional view taken along the line VI—VI of FIG. 5.

In FIGS. 5 and 6, an embodiment of the present invention is shown to comprise front exhaust pipes 30 and 32 having tapered downstream end portions 30*a* and 32*a* which are inserted into the upstream branches 28*a* and 28*b* of the exhaust pipe joint 28 to form predetermined annular spaces $S_1$ between the tapered downstream end portions 30*a* and 32*a* and the upstream branches 28*a* and 28*b*. More specifically, the front exhaust pipes 30 and 32 have the downstream end portions 30*a* and 32*a* which are tapered toward the distal ends, that is, formed to become gradually smaller in diameter toward the distal ends. The front exhaust pipes 30 and 32 also have straight, uniform-in-diameter pipe portions 30*b* and 32*b* in which the larger diameter ends of the tapered downstream end portions 30*a* and 32*a* terminate and adapted to fit at the straight pipe portions 30*b* and 32*b* closely or snugly in the upstream branches 28*a* and 28*b* of the exhaust pipe joint 28 while forming the annular spaces $S_1$ between the conical outer walls of the tapered downstream end portions 30*a* and 32*a* and the inner walls of the upstream branches 28*a* and 28*b*. The exhaust pipe joint 28 is substantially the same as that of the prior art exhaust system of FIG. 1 and its upstream branches 28*a* and 28*b* have at the upstream ends thereof straight bore portions 28*d* and 28*e* in which the straight pipe portions 30*b* and 32*b* fit closely or snugly and curved bore portions 28*f* and 28*g* gradually curving to come closer toward the downstream ends thereof. The curved bore portions 28*e* are adapted to cooperate with the tapered downstream end portions 30*a* and 32*a* to define therebetween the annular spaces $S_1$. The tapered downstream end portions 30*a* and 32*a* can be formed by pressing from straight and uniform-in-diameter pipe end portions and therefore can be obtained easily and economically.

The exhaust system structured as above operates as follows.

As the burned gases (exhaust) are discharged from the associated engine cylinders (not shown) into the exhaust system, exhaust pressure waves arise in the exhaust manifold 12 and propagate through the front exhaust pipes 30 and 32 to the exhaust pipe joint 28. Therefore, the exhaust pressure waves propagate through the exhaust line in the direction of the flow of the exhaust gases and change at the end of the tailpipe 26 into reflected waves that propagate back through the exhaust line to the exhaust pipe joint 28 and tend to propagate further therefrom to the front exhaust pipes 30 and 32. However, the exhaust pressure waves tending to propagate from the exhaust pipe joint 28 to the front exhaust pipes 30 and 32 are led into the space $S_1$ and thereby prevented from propagating further back through the exhaust line. Accordingly, the exhaust system of this invention can effectively prevent shock waves from being caused at the front exhaust pipes 30 and 32 and thus can reduce an exhaust noise and increase an exhaust efficiency and therefore an engine output.

Figure 7:
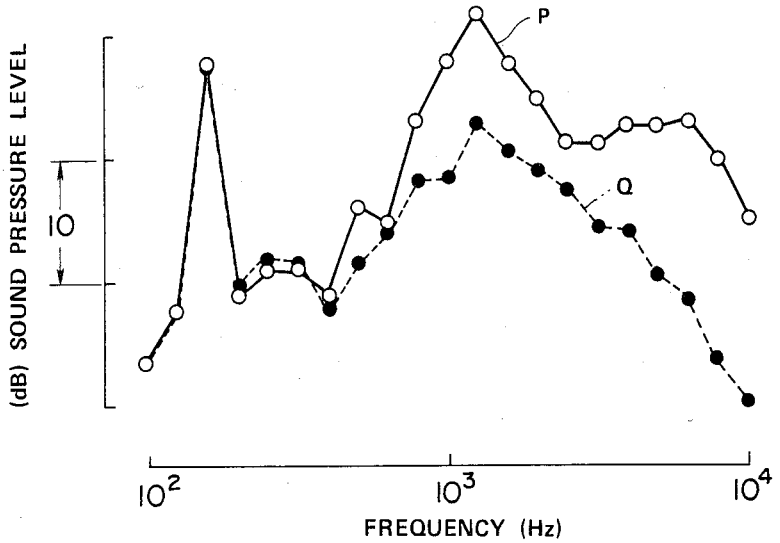
FIG. 7 is a graph showing by the dotted line a sound pressure level-frequency characteristic effected by the exhaust system of this invention and by the dotted line a corresponding characteristic effected by the comparable prior art exhaust system.

FIG. 7 is a graph showing by the dotted line a sound pressure level-frequency characteristic effected by the exhaust system of the present invention under a condition in which an engine is being decelerated and rotating at 4,800 rpm and by the solid line a corresponding characteristic effected by the prior art exhaust system.

As will be understood from this graph, the sound pressure level of the exhaust system of the present invention is considerably reduced as represented by the line P as compared with the corresponding sound pressure level of the prior art exhaust system as represented by the line Q.

Figure 8:
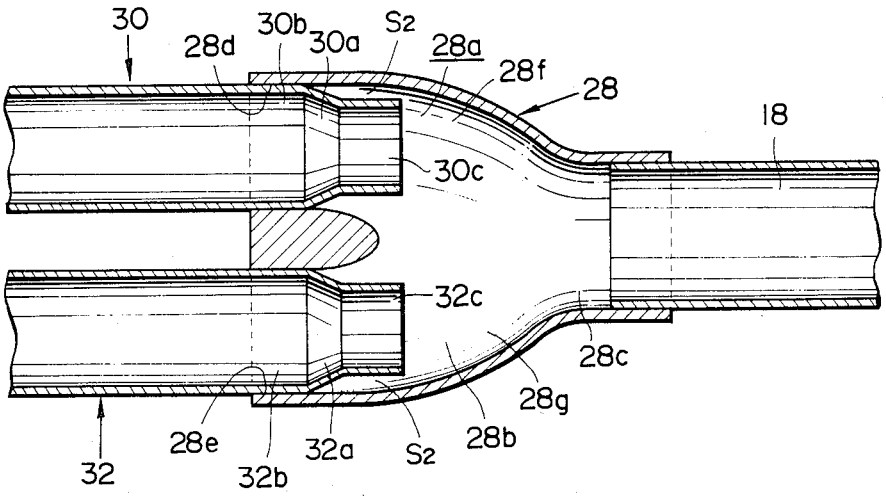
FIGS. 8 to 10 show modified embodiments of the present invention.

FIG. 8 shows a modified embodiment of the present invention. In this embodiment, the front exhaust pipes 30 and 32 are further formed with straight smaller-diameter downstream end extensions 30*c* and 32*c* which are uniform in diameter and in which the smaller diameter ends of the tapered downstream end portions 30*a* and 32*a* terminate, that is, the front exhaust pipes 30 and 32 are formed with such downstream end extensions 30*c* and 32*c* that extend consecutively from the smaller diameter ends of the tapered downstream end portions 30*a* and 32*a* in the direction opposite to the straight pipe portions 30*b* and 32*b*. The downstream end extensions 30*c* and 32*c* cooperate with the tapered downstream end portions 30*a* and 32*a* as well as the upstream branches 28*a* and 28*b* of the joint 28 to define therebetween predetermined annular spaces $S_2$.

With the above structure, the space $S_2$ can be longer axially of the exhaust pipes 30 and 32 as compared with the space $S_1$ in the previous embodiment, thereby propagation of exhaust pressure waves (reflected waves) from the exhaust pipe joint 28 back to the front exhaust pipes 30 and 32 can be prevented more assuredly and effectively.

Figure 9:
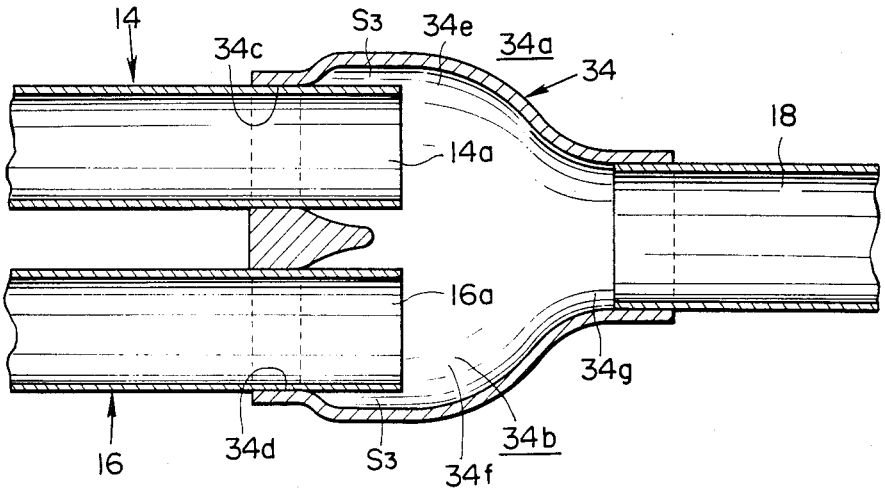

FIG. 9 shows a further modification of the present invention. In this modification, the front exhaust pipes 14 and 16 are formed to be uniform in diameter throughout the length thereof and have straight downstream end portions 14*a* and 16*a*, and an exhaust pipe joint 34 has upstream branches 34*a* and 34*b* into which the end portions 14*a* and 16*a* are inserted by a predetermined length and which are partly bulged to form predetermined annular spaces $S_3$ between the outer and inner walls of the end portions 14*a* and 16*a* and the branches 34*a* and 34*b*. More specifically, the branches 34*a* and 34*b* have straight bore portions 34*c* and 34*d* in which the end portions 14*a* and 16*a* are in part fitted closely or snugly and increased bore portions or bulged portions 34*e* and 34*f* which are located downstream of the bore portions 34*c* and 34*d* and cooperate with the cylindrical outer wall of the inserted exhaust pipe end portions 14*a* and 16*a* to define therebetween the spaces $S_3$. The exhaust pipe joint 34 also has a downstream branch 34*g* in which the rear exhaust pipe 18 is fitted. The bulged shapes of the branches 34*a* and 34*b* can be formed by pressing.

This embodiment can produce substantially the same effect as the previous embodiments.

Figure 10:
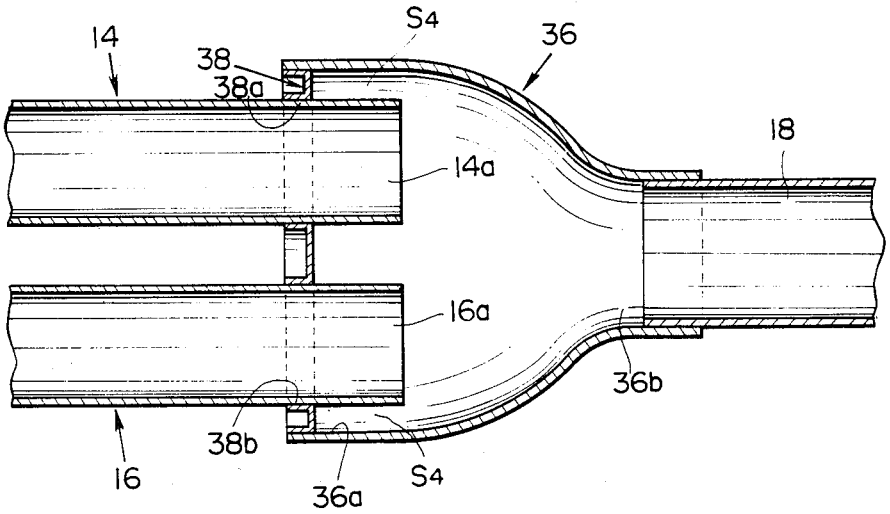

FIG. 10 shows a further modification of the present invention. In this embodiment, an exhaust pipe joint 36 is formed to have a siamese upstream end 36*a* and which is fitted a baffle plate 38 and a downstream end 36*b* in which the rear exhaust pipe 18 is fitted. The baffle plate 28 is formed with a pair of flanged holes 38*a* and 38*b* in which the downstream end portions 14*a* and 16*a* of the front exhaust pipes 14 and 16 are in part fitted closely or snugly. The end portions 14*a* and 16*b* are adapted to project into the joint 36 by a predetermined length to form therearound predetermined annular spaces $S_4$.

This embodiment can produce substantially the same effect as the previous embodiments.

What is claimed is:

1. An exhaust system for an automotive engine comprising:

a pair of front exhaust pipes;

a rear exhaust pipe located downstream of said front exhaust pipes;

an exhaust pipe joint joining said front exhaust pipes to said rear exhaust pipe and trifurcated to have two upstream branches with striaght bore portions in which said front exhaust pipes are snugly fitted and one downstream branch in which said rear exhaust pipe is fitted;

said front exhaust pipes having downstream end portions projecting into said exhaust pipe joint and also having outer walls, said upstream branches of said exhaust pipe joint having inner walls surrounding said outer walls; and means including said inner walls and said outer walls cooperating to form annular spaces around said downstream end portions for receiving reflected waves travelling in the upstream direction and limiting the propagation of said reflected waves into said downstream ends of said front exhaust pipes.

2. An exhaust system as forth in claim 1, in which said downstream end portions of said front exhaust pipes are uniform in diameter and straight and have cylindrical outer walls, and in which said upstream branches of said exhaust pipe joint are in part bulged and have inner walls surrounding said cylindrical walls and cooperating therewith to form said annular spaces therebetween, said cylindrical outer walls of said straight downstream end portions of said front exhaust pipes and said inner walls of said partly bulged upstream branches of said exhaust pipe joint constituting said annular space forming means.

3. An exhaust system as set forth in claim 2, in which said upstream branch portions of said exhaust pipe joint have straight bore portions in which said downstream end portions of said front exhaust pipes are in part fitted snugly and also have increased bore portions which are located downstream of said straight bore portions, said inner walls of said partly bulged upstream branches comprising inner walls of said increased bore portions.

4. An exhaust pipe as set forth in claim 1, in which said exhaust pipe joint has a siamese upstream end for connection with said front exhaust pipes and a downstream branch in which said rear exhaust pipe is fitted, and in which a baffle plate is fitted in said siamese upstream end, said baffle plate having a pair of flanged holes in which said downstream end portions of said front exhaust pipes are fitted snugly and project into said exhaust pipe joint to provide outer walls which cooperate with an inner wall of said exhaust pipe joint to form therebetween said annular spaces, said outer walls of said downstream end portions of said front exhaust pipes, said inner wall of said exhaust pipe joint and said baffle plate constituting said annular space forming means.

5. An exhaust system for an automotive engine comprising:

a pair of front exhaust pipes;

a rear exhaust pipe located downstream of said front exhaust pipes;

an exhaust pipe joint joining said front exhaust pipes to said rear exhaust pipe and trifurcated to have two upstream branches with straight bore portions in which said front exhaust pipes are snugly fitted and one downstream branch in which said rear exhaust pipe is fitted;

said front exhaust pipes having downstream end portions projecting into said exhaust pipe joint and also having cylindrical outer walls, said upstream branches of said exhaust pipe joint having inner walls surrounding said cylindrical outer walls; and means including said inner walls and said outer walls to form annular spaces around said downstream end portions for receiving reflected waves travelling in the upstream directions and limiting the propagation of said reflected waves into said downstream ends of said front exhaust pipes;

said downstream end portions of said front exhaust pipes being tapered toward the distal ends to have conical outer walls, said conical outer walls of said tapered downstream ends of said front exhaust pipes and said inner walls of said upstream branches of said exhaust pipe joint constituting said annular space forming means.

6. An exhaust system as set forth in claim 5, in which said front exhaust pipes have straight, uniform-in-diameter pipe portions in which the larger diameter ends of said tapered downstream end portions terminate, and in which said upstream branches of said exhaust pipe joint have at the upstream ends thereof straight bore portions in which said straight pipe portions are snugly fitted and also have curved bore portions curving to come closer toward the downstream ends thereof, said inner walls of said upstream branches comprising inner walls of said curved bore portions.

7. An exhaust system as set forth in claim 6, in which said front exhaust pipes are further formed with downstream end extensions which extend consecutively from the smaller diameter ends of said tapered downstream end portions in the direction opposite to said straight pipe portions, said downstream end extensions additionally constituting part of said annular space forming means.

* * * * *